US009879470B2

(12) United States Patent
Clarke, Jr. et al.

(10) Patent No.: US 9,879,470 B2
(45) Date of Patent: Jan. 30, 2018

(54) ELECTRICAL MULLION RECEPTACLE

(71) Applicant: Frame & Mullions, LLC, Henrico, VA (US)

(72) Inventors: James Thomas Clarke, Jr., Henrico, VA (US); Kenneth Russell Snow, Clear Brook, VA (US)

(73) Assignee: Frame & Mullions LLC, Henrico, VA (US)

( * ) Notice: Subject to any disclaimer, the term of this patent is extended or adjusted under 35 U.S.C. 154(b) by 0 days.

(21) Appl. No.: 15/493,185

(22) Filed: Apr. 21, 2017

(65) Prior Publication Data

US 2017/0306688 A1 Oct. 26, 2017

Related U.S. Application Data

(60) Provisional application No. 62/325,625, filed on Apr. 21, 2016.

(51) Int. Cl.

| | |
|---|---|
| ***E06B 1/52*** | (2006.01) |
| ***E06B 7/28*** | (2006.01) |
| ***E06B 1/70*** | (2006.01) |
| ***E05C 19/00*** | (2006.01) |
| ***E05B 65/06*** | (2006.01) |

(52) U.S. Cl.

CPC ..... *E06B 1/524* (2013.01); *E05B 65/06* (2013.01); *E05C 19/00* (2013.01); *E06B 1/528* (2013.01); *E06B 1/70* (2013.01); *E06B 7/28* (2013.01)

(58) Field of Classification Search

CPC . E06B 1/524; E06B 1/52; E06B 1/528; E06B 7/28; E06B 1/70; E05B 65/06; E05C 19/00

USPC .... 52/210, 211, 212, 213, 215, 217; 49/467, 49/468, 469, 470, 471

See application file for complete search history.

(56) References Cited

U.S. PATENT DOCUMENTS

| | | | | |
|---|---|---|---|---|
| 4,074,464 A * | 2/1978 | McCay | ..... | E06B 1/70 49/468 |
| 4,104,830 A * | 8/1978 | Eagle | ..... | E06B 1/70 49/468 |
| 4,387,535 A * | 6/1983 | Corbo | ..... | E06B 1/70 49/468 |

(Continued)

*Primary Examiner* — Brian E Glessner
*Assistant Examiner* — Adam G Barlow
(74) *Attorney, Agent, or Firm* — John H. Thomas, P.C.

(57) ABSTRACT

A door mullion receptacle box assembly includes a toe plate, a channel box and block components. When a mullion is removed from a building/room opening, the toe plate may be fixed in the mullion receptacle box thus creating a uniform threshold across the width of the door openings. Using the assembly described herein, however, there are no large diameter holes in the top of the toe plate and no projections into the opening that could be a trip hazard. The present assembly replaces traditional fixed sill blocks mounted to the floor, or to the top of a threshold to anchor the bottom of conventional mullions. A typical mullion is locked in place with a lock at the top of the mullion. When installed, this mullion is placed over the sill block at the sill and tilted into place and locked into a header block at the top of the mullion. However because the components of the conventional sill blocks project up into the mullion from the thresholds, they become a trip hazard and a liability when the mullion is temporarily removed.

10 Claims, 9 Drawing Sheets

(56) References Cited

U.S. PATENT DOCUMENTS

| | | | | | |
|---|---|---|---|---|---|
| 5,136,814 | A * | 8/1992 | Headrick | E06B 1/70 | 49/468 |
| 6,061,967 | A * | 5/2000 | Judds | E06B 1/70 | 49/304 |
| 6,138,413 | A * | 10/2000 | Fehr | E06B 1/30 | 49/382 |
| 7,350,336 | B2 * | 4/2008 | Bennett | E06B 1/70 | 49/467 |
| 8,567,128 | B2 * | 10/2013 | Van Camp | E06B 1/70 | 49/468 |
| 2002/0069589 | A1 * | 6/2002 | Bennett | E06B 1/524 | 49/470 |
| 2015/0052820 | A1 * | 2/2015 | Van Camp | E06B 1/70 | 49/468 |
| 2016/0340970 | A1 * | 11/2016 | Mitchell | E06B 7/2305 | |
| 2017/0016268 | A1 * | 1/2017 | Reyes | E06B 1/70 | |

* cited by examiner

ELECTRICAL MULLION RECEPTACLE

This application claims the benefit of U.S. Provisional Application No. 62/325,625, filed Apr. 21, 2016 and entitled "Electrical Mullion Receptacle", which is incorporated by reference herein in its entirety.

The present invention is a mullion receptacle box for electric mullions that are flush mounted directly into a threshold at the center of openings where pairs of doors meet, and when low voltage electrical cable connectors are present at the top of a mullion. The receptacle box assembly includes a toe plate, a channel and block components. When a mullion is removed from a building/room opening, the toe plate may be fixed in the mullion receptacle box to create a uniform threshold across the width of the door openings. There are no large diameter holes in the top of the toe plate and no projections into the opening that could be a trip hazard. The invention replaces traditional fixed sill blocks mounted to the floor, or to the top of a threshold to anchor the bottom of conventional mullions.

BACKGROUND

Many types of doors and hardware are used in hard traffic, commercial, institutional, and industrial door openings in buildings. When trying to achieve a specific function and design for an opening, the factors of aesthetics, security and resistance to abuse must be considered. Often when double doors are installed at a particular location, a necessary piece of hardware is a center mullion. Depending on the design and function of the opening, a mullion may be permanently fixed in place to secure the doors, or the mullion can be engineered so that it is removable, for example with a key. In this case the mullion is defined as a hardware mullion.

A mullion provides a vertical structure that two push bar panic devices can be locked into, and enables locking of a pair of doors from the outside. The push bars on the inside of the doors cannot be locked from the inside. They are always operable to open the door and exit a room, corridor or building when the bar is pushed. A keyed removable electric hardware mullion is a hollow rectangular or square, steel or aluminum post that allows an electric strike to be mounted onto one, or both, of the mullion faces.

In conventional doorways that include a mullion and a pair of doors, the pair of doors are closed and locked by the electric strikes, which capture the panic device latch bolts until they are released by a remote low voltage signal, such as a key switch, push button or through a card reader credential or keypad.

Mullions can be temporarily removed by key when a wider opening is needed. A mullion is held in place by an aluminum or steel header block mounted to the underside of a door frame header at the top of the mullion. The header block is fitted with an electrical cable connection that is easily disconnected when the mullion is removed. When installed, cables are connected at the top of the mullion, and the mullion is fitted around the block at the top. The bottom of the mullion is then swung into place and locked into the electrical mullion receptacle at the threshold.

Alternative, conventional, and electric types of mullion are locked in place with a lock at the top of the mullion. When installed, this mullion is placed over a sill block at the sill of the threshold and tilted into place and locked into a header block at the top of the mullion. However because the components of the sill blocks project up into the mullion above the threshold, they may become a trip hazard and a potential issue when the mullion is temporarily removed.

The Americans with Disabilities Act disallows the use of a threshold thicker than ½" in an employee entrance or accessible route.

Also, some mullions, especially electric mullions, that use electric strikes to secure an opening, are difficult to remove and reinstall especially when the locking mechanism and the cable connections are both at the top of the mullion.

Sometimes, in order to enable the installation and removability of a mullion, a threshold must have a notch or slot cut out of it so the sill block can be mounted to the floor and not on top of the threshold to facilitate the mullion's removability. The slotted threshold is exposed when the mullion needs to be removed and may also become a trip hazard and an issue.

BRIEF DESCRIPTION OF THE DRAWINGS

FIG. 2A is a top view thereof. FIG. 2B is a side view thereof. And FIG. 2C is a front view thereof.

FIG. 3A is a perspective view thereof. FIG. 3B is a top view thereof.

FIG. 3C is a side view thereof. And FIG. 3D is a front view thereof.

FIG. 4A is a perspective view thereof. FIG. 4B is a top view thereof. And FIG. 4C is a front view thereof.

FIG. 5A is a top view thereof. FIG. 5B is a side view thereof. And FIG. 5C is a front view thereof.

DETAILED DESCRIPTION

Many buildings are designed with relatively wide openings whether they are outside doors or inside doors. These wide openings, in many places, require pairs of doors. Pairs of door assemblies are traditionally anchored and made secure with a center mullion. These mullions may be permanently fixed in place in an opening as a part of a steel or aluminum framing system during the construction process. However, the present discussion is directed to removable mullions.

Removable mullions are traditionally installed in one of two ways. In a first example, the bottom of the mullion is placed in a receptacle in the threshold of the doorway. The top is then tilted into place and fixed or locked in its vertical position at the top of the mullion. Alternatively, the top of the mullion may be placed first on to a header block at the top or header of a doorway. Then the bottom of the mullion is swung into its fixed vertical position and fixed or locked into a sill block at the threshold or bottom of the doorway.

The present invention is directed to a mullion receptacle in the bottom or threshold of a doorway where the top of the mullion would be first placed or connected in the top or header of the doorway and then swing or rotated into place in a receptacle in the bottom doorway threshold. In the present example, the header may have an electrical connection that is adapted to receive a mating connection in the top of the mullion in order to power and control an electrical strike, for instance. These mullions are referred to as "electric" or "electrical" mullions interchangeably.

The rectangular geometry of a conventional mullion requires that when the bottom of the mullion is swung or tilted into its fixed vertical position. It must be shorter on its leading edge than the distance between the bearing surface at the bottom of the mullion and the underside of the frame header.

Figure 6:
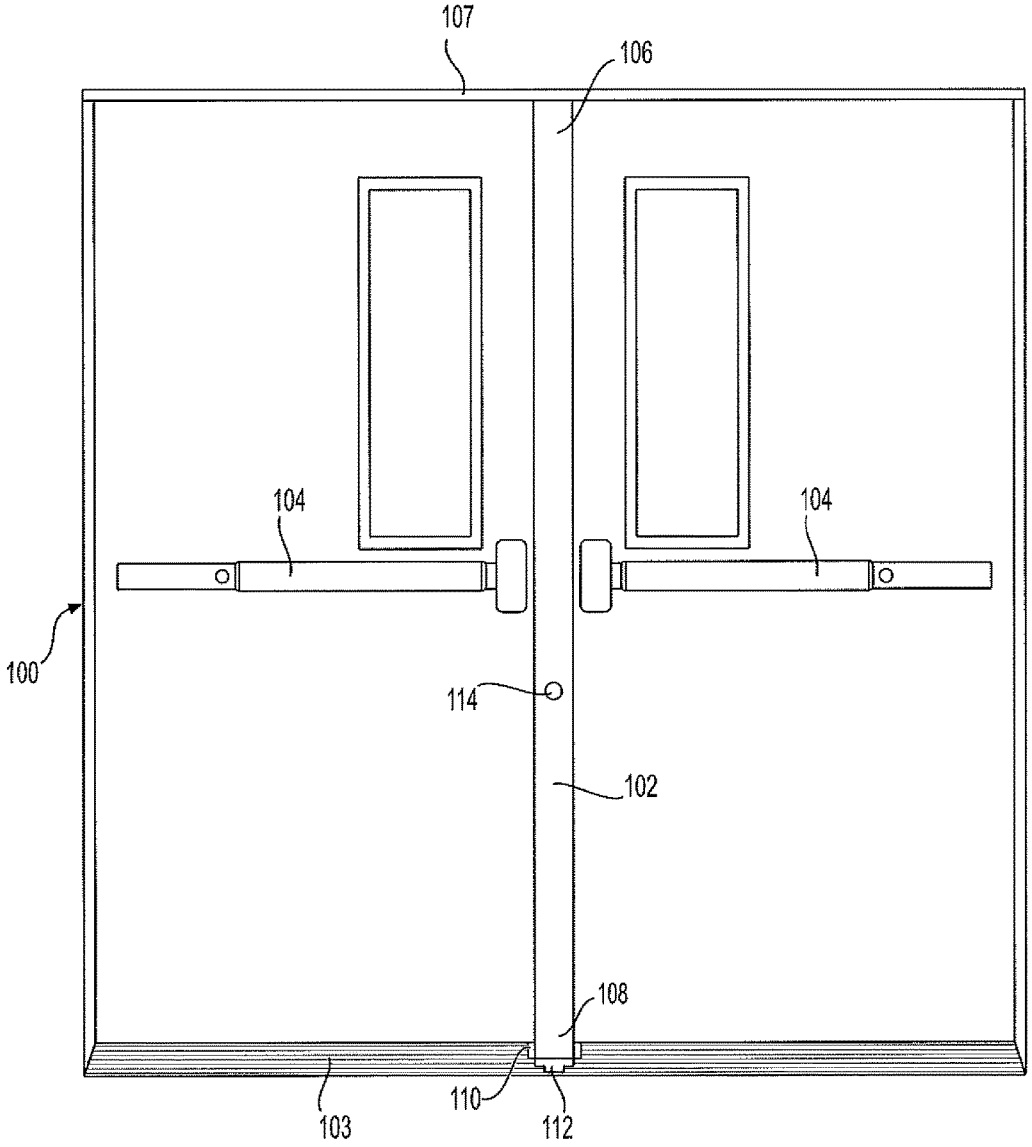
FIG. 6 is a perspective view of a doorway with two doors that close onto a mullion in the middle. This doorway has a mullion receptacle box as described herein.
Figure 9:
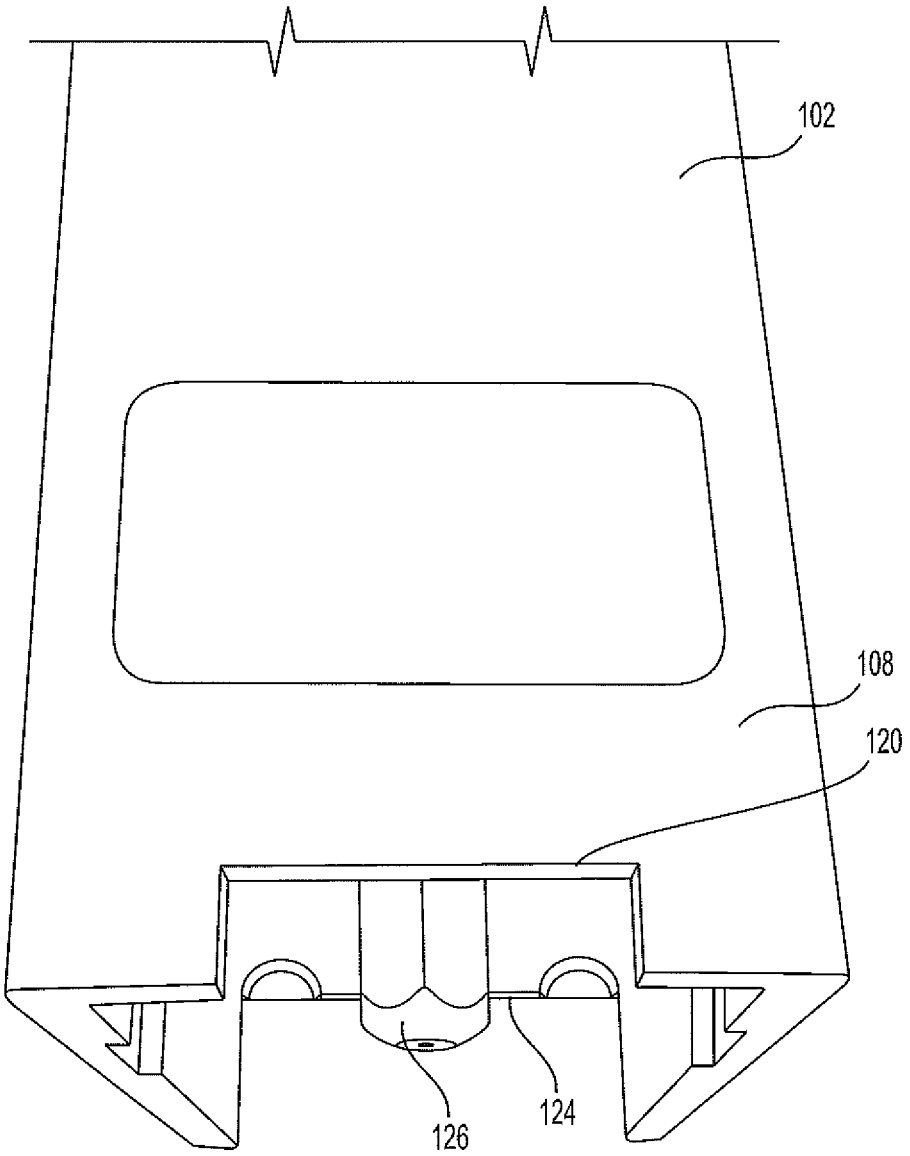
FIG. 9 is a perspective view of the bottom of a mullion that is positioned in the mullion receptacle.

Referring first to FIG. 6, there is shown a doorway 100 and a center mullion 102 installed in the middle of the doorway. A threshold 103 spans the bottom of the doorway 100. A doorway header 107 spans the top of the doorway 100. The bottom portion 108 of the mullion 102 is shown positioned in a mullion receptacle box 110. The top portion 106 of the mullion 100 is fixed to the header block 107. A key lock 114 is shown in the mullion 102. The key lock 114 actuates a bolt/rod assembly (not shown) inside the mullion 102 to raise (unlocked position) and lower (locked position) the locking bolt in the block lock hole 44 (shown in FIG. 1 and FIGS. 5A-5C). In FIG. 9, a locking bolt 126 is shown as mounted for example in mullion 102. The locking bolt 126 is shown in the lower, locked position in FIG. 9 where, once installed in the mullion 110, the bolt would slide into and lock into the block lock hole 44.

Figure 7:
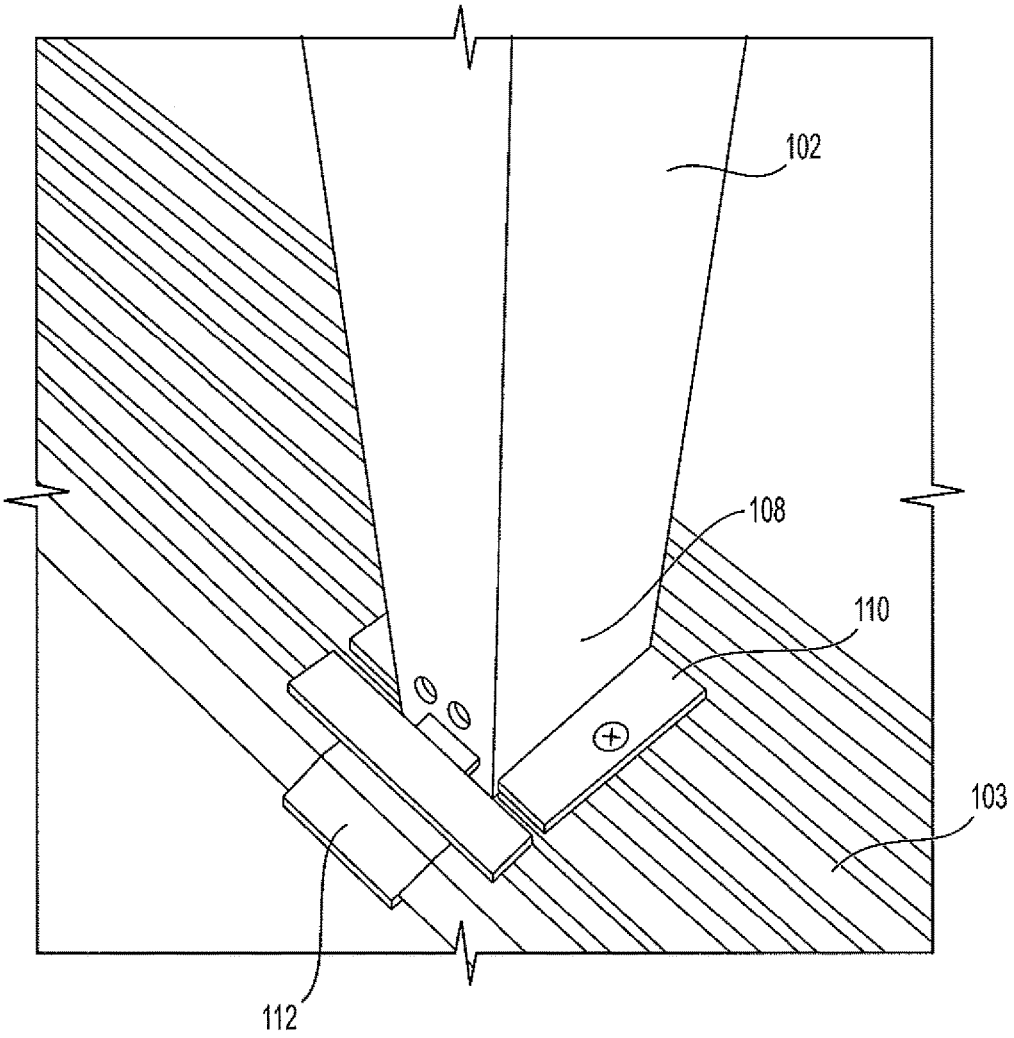
FIG. 7 is a perspective view of the bottom of a mullion installed in a mullion receptacle assembly as described herein.

FIG. 7 is a close-up, perspective view of the mullion 102 fixed in the mullion receptacle box 110. The bottom portion 108 of the mullion 102 is secured in the mullion receptacle box 110. The mullion receptacle box 110 is secured with screws that pass through the threshold 103 into anchors in the floor beneath the threshold. The bottom portion 108 of the mullion 102 is secured in the mullion receptacle box 110 when the locking bolt is projected down through the block lock hole 44 and through hole 68 in toe plate 60. This prevents the front toe plate 112 from swinging outwardly and then being disconnected from the header block at the top of the mullion 102.

FIGS. 1, 2A-2C, 3A-3D, 4A-4C and 5A-5C illustrate an embodiment of a multi-component mullion receptacle that allows the bottom of a mullion to be securely nested in a threshold receptacle without interference from the threshold in which the receptacle is positioned. A removable toe plate allows the mullion to swing in and out of place without being blocked by the threshold. When the mullion is removed, the toe plate may then be reinserted in the receptacle assembly to make uniform the face of the threshold plate. A retainer screw is then moved from storage hole 71 to hole 48 which keeps the toe plate I position in block 60. The receptacle must be constructed so that the internal dimensions of the rectangular receptacle will allow enough clearance to properly receive the mullion.

FIGS. 1, 2A-2C, 3A-3D, 4A-4C and 5A-5C illustrate the new mullion assembly described herein when mounted in a threshold (FIG. 1) and each of its parts individually and assembled (FIGS. 2A-2C, 3A-3D, 4A-4C and 5A-5C). The threshold and mullion assembly pictured in the drawings are envisioned in use at the bottom of the double doorway in order to provide a solid base for the mullion, thereby lending integrity to the double door system. Specifically, the wiring at the top of the mullion will be connected first before it is fitted over the header block and swung into place in the mullion receptacle assembly for securement.

Figure 1:
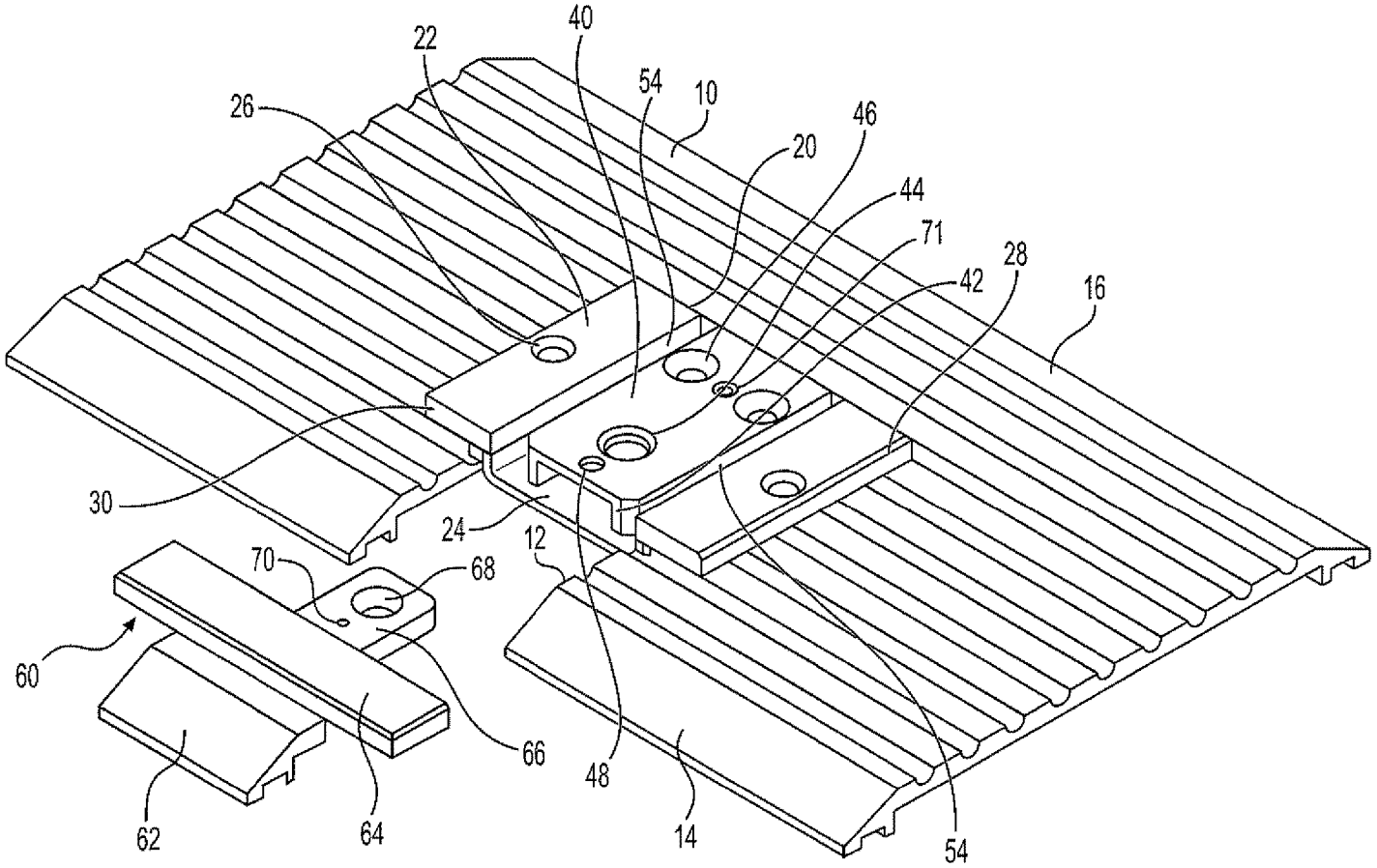
FIG. 1 is a perspective view of a combination of a threshold and mullion receptacle assembly with the toe plate component shown removed from the mullion channel box and block assembly.
Figure 2A:
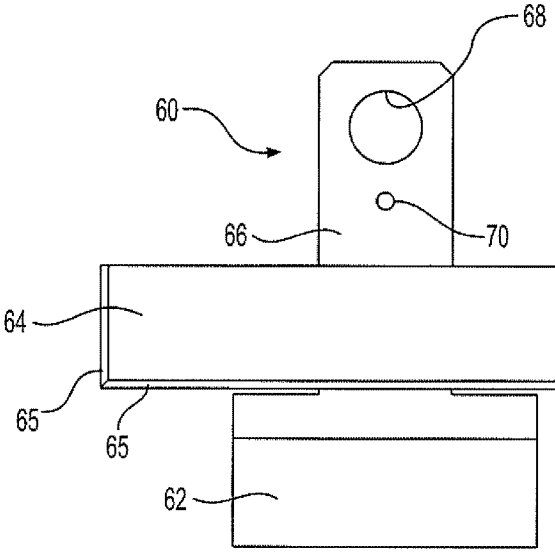
FIGS. 2A-2C are views of the toe plate component only of the mullion box assembly.
Figure 2C:
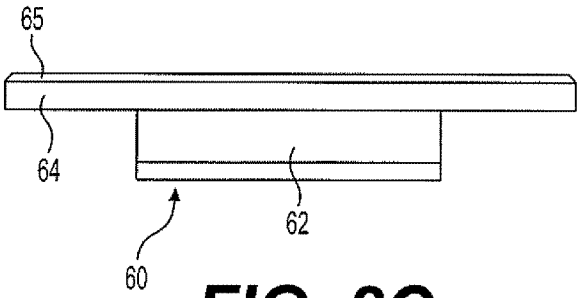
Figure 2B:
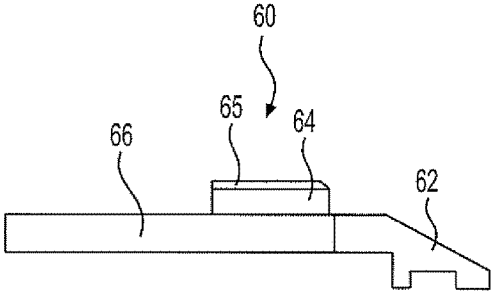
Figure 3B:
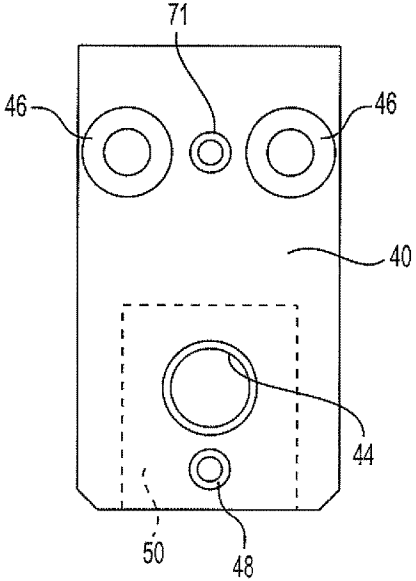
FIGS. 3A-3D are views of the block component only of the mullion box assembly.
Figure 3D:
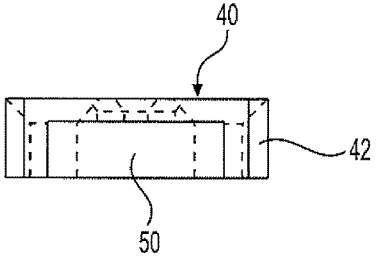
Figure 3A:
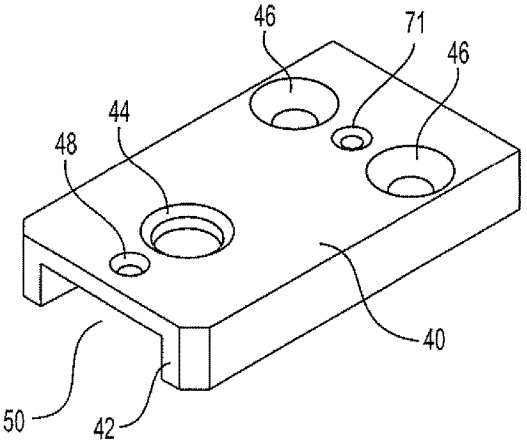
Figure 3C:
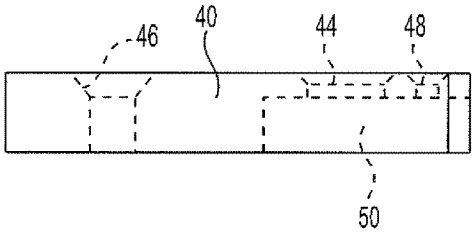
Figure 4B:
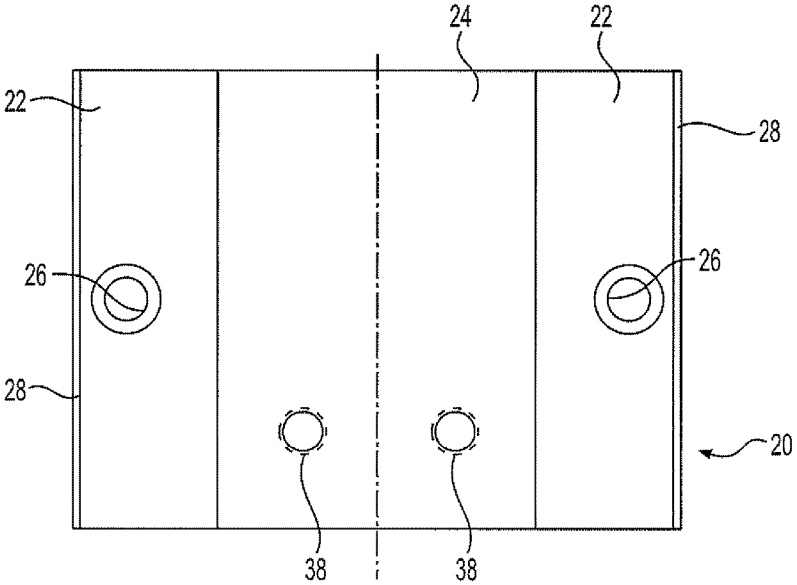
FIGS. 4A-4C are views of the channel component only of the mullion box assembly.
Figure 4C:
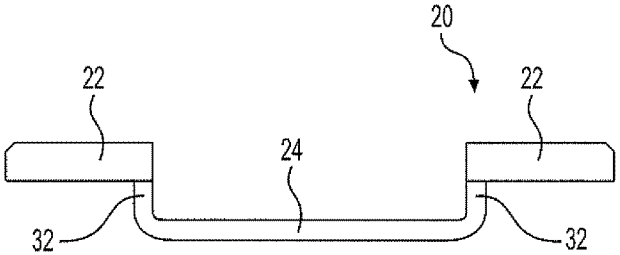
Figure 4A:
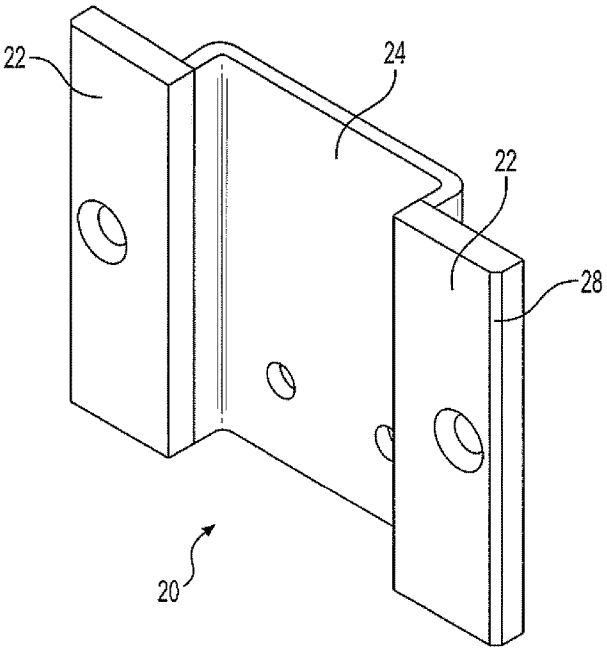
Figure 5A:
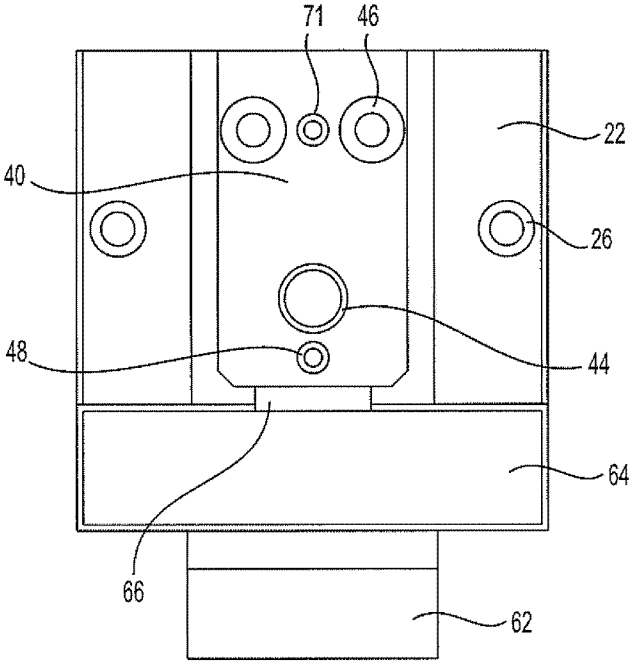
FIGS. 5A-5C are views of the combination of the toe plate, channel and block components as assembled.
Figure 5C:
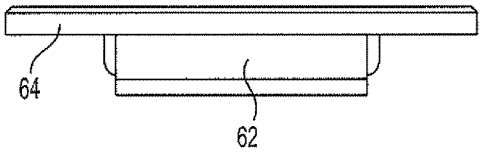
Figure 5B:
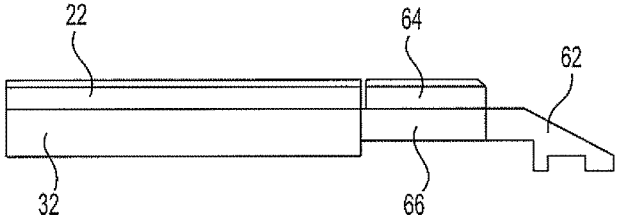

As shown in FIG. 1, a threshold 10 has a beveled front threshold edge 14 and a beveled back edge 16. The threshold 10 has a length that corresponds to the width of a doorway where the threshold is or will be installed. Moreover, the width of the threshold may be a conventional 6-12 inches in width to cover the transition from outside to inside a room or hallway or building. The threshold 10 further includes a rectangular notch cutout 12 on the front side that is cut out of the front threshold edge 14. This cutout will typically be made in about the middle of the length of the threshold assuming that the two doors that close onto the mullion are of equal width. Asymmetric doors may mean that the notch cutout would be somewhere else along the length of the threshold to accommodate the different width doors. Importantly, the notch cutout only extends a part way across the width of the threshold, typically about the middle of the width of the threshold, in order to retain the integrity of the entire threshold. Positioned in the notch cutout 12 is a mullion channel box 20. The mullion channel box 20 includes a base 24 and side edge flanges 22. The mullion channel box 20 also has side walls 32. The height of the side walls 32 defines the depth of the mullion channel box 20. The side edge flanges 22 have beveled edges 28 on the top outer edges thereof. The side flanges 22 also have a flat front face 30 on each of those flanges. The mullion channel box 20 also includes screw holes 26 that secure the side edge flanges 22 to anchors beneath threshold 10. The thickness of the side edge flanges 22 may range, depending on the materials used, from about $1/16^{th}$ of an inch to about ⅜ths of an inch. The base 24 of the box 20 further includes additional screw holes 38 in the bottom thereof to secure the box to a block 40 fixed onto the top of the base 24.

The block 40 is fixed onto the base 24 of the mullion channel box 20. The block 40 includes front side walls 42 and a block lock hole 44. The block 40 further includes a set screw hole 48 proximate the front of the top of the block that holds the tongue 66 when the mullion has been removed from the opening. There are also block screw holes 46 to secure that block to the base screw holes 26 inside the mullion channel box 20. The block 40 further includes a front aperture 50 that is generally rectangular. The front aperture 50 is the space between the front side walls 42. The height of the block 40 is substantially the same as the depth of the mullion channel box 20 as defined by the height of the side walls 32 so that once the block is fixed into the channel box, a substantially smooth surface is provided on the top of the assembled channel box and block.

A toe plate 60 is adapted to slide into the front aperture 50 of the block 40. The toe plate 60 includes a toe plate threshold edge 62 and toe plate box front edge flange 64. The toe plate 60 further includes a tongue 66 extending backwardly opposite the toe plate threshold edge 62. The tongue 66 is inserted to the front aperture 50 of the block 40. The tongue 66 includes a set screw hole 70 to secure the toe plate 60 in the channel box 20 when the mullion is removed from the opening. The toe plate threshold edge 62 is beveled to be approximately the same bevel and dimension as the front threshold edge 14 so that once installed, the front edge of the threshold and toe plate combination is a generally uniform edge.

Figure 8:
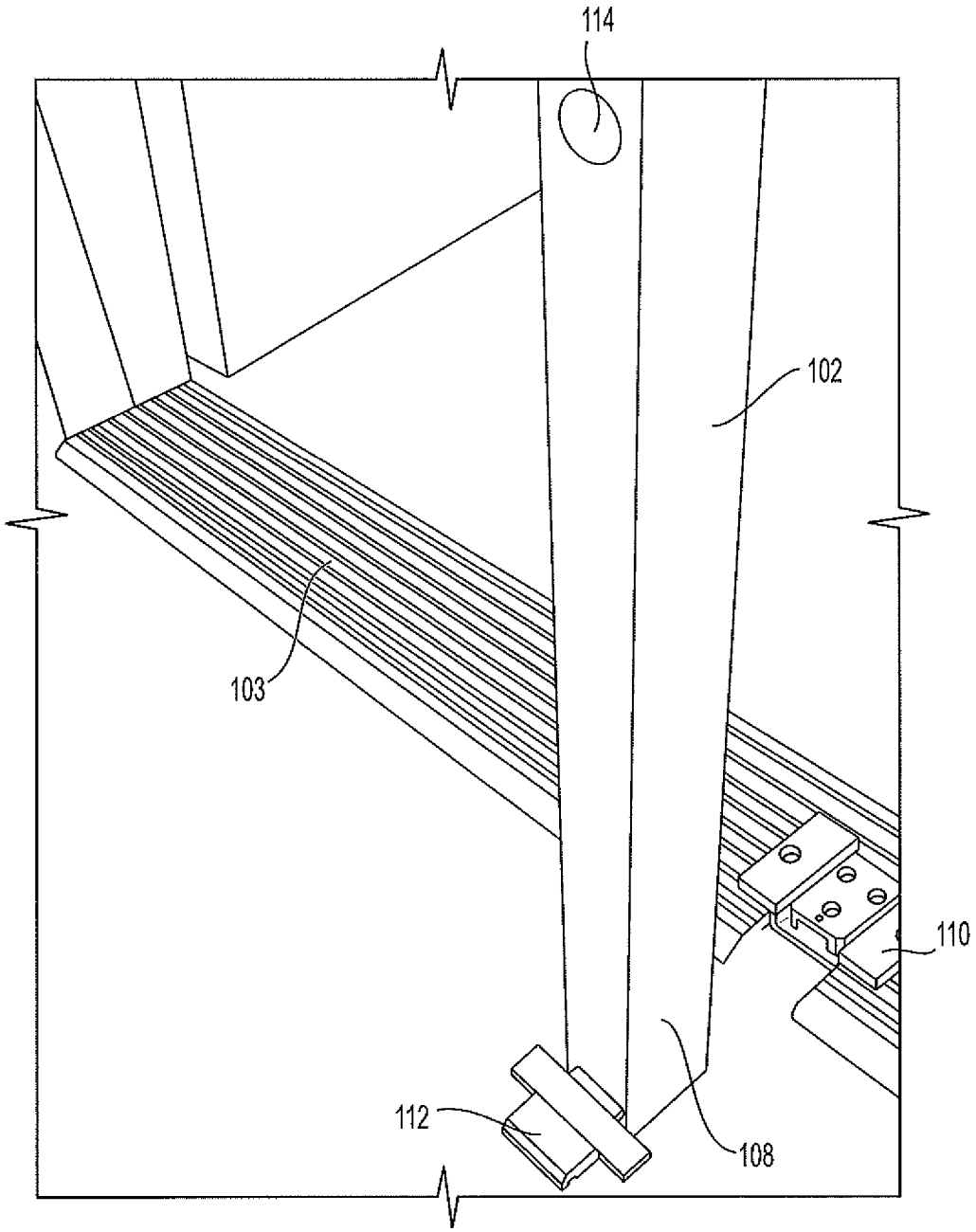
FIG. 8 is a perspective view of the bottom of a mullion in a partially offset position with respect to a mullion receptacle assembly as described herein. This figure illustrates a manner of installation of the mullion being swung into position in the receptacle assembly.

In operation, the toe plate 60 is removed from the mullion channel box 20 and block 40. The mullion can then be fixed in top of a doorway and swung around into place around the block 40. FIG. 8 shows the toe plate 112 removed from the receptacle box 110 and the bottom portion 108 of the mullion 102 swung out from the threshold 103 and the receptacle box. Returning again to FIG. 1, there are slots 54 formed between the block 40 and side walls 32 of the channel box 20. The side walls of the bottom portion 108 of the hollow mullion 102 are adapted to be received in those slots 54. Referring to FIG. 9, the bottom portion of a mullion 108 has the front and back of a mullion face are trimmed up to form a front gap 120 and back gap 124 so that the mullion can slide over a mullion block such as the block 40. Once in its vertical position, the mullion is locked in place by sliding the toe plate 60 tongue 66 into the slot 50 of the block. Once the toe plate 60 is place, then a locking bar 126 inside the mullion 102 can be turned by a key or electric lock and slide into the overlapping lock holes 44 on the block 40 and lock hole 68 in the tongue 70. In this way, the front edge 14 of the threshold 10 lines with the toe plate threshold edge 62 to provide a uniform doorway threshold edge. Moreover, the toe plate box front edge flange 64 secures the mullion in place inside the grooves 54 so that the mullion is likewise locked and fixed into its vertical position.

In FIG. 8, the toe plate 112 is shown as removed from the channel box 110. In practice, as noted earlier, the toe plate 112 may be reinserted into the channel box 110 after removal of the mullion 102 in order to present a flat surface without any significant holes or gaps in the surface thereof. In this way, the threshold 103 is generally continuous and relatively flat and safe to walk over.

The mullion receptacle box, block and toe plate described herein may be formed of different materials, or they may be the same material. They are expected to be formed of aluminum or steel, but hardy plastics or composites may also be used. Metal materials are believed to be the most durable.

Other embodiments of the present invention will be apparent to those skilled in the art from consideration of the specification. It is intended that the specification and figures be considered as exemplary only, with a true scope and spirit of the invention being indicated by the claims.

That which is claimed is:

1. A mullion receptacle assembly adapted for use in a doorway threshold, the assembly comprising:

a channel box, a block, and a toe plate;

wherein the channel box has a rectangular base connected at the bottom of a pair of sidewalls on opposite sides of the base, and raised side edge flanges attached to the top of each sidewall with the base, sidewalls and flanges forming a rectangular channel and defining a channel width between the sidewalls, and wherein the channel box has a front side that is open to the base;

wherein the block is generally rectangular in shape and is sized to fit inside the channel box and is further adapted to be attached to the base of the channel box, wherein the block has a block width that is less than the channel width and further wherein the block is attached to the base in generally the middle of the base so that slots are formed on either side of the block between the block and the channel box sidewalls, and further wherein the block is hollow and has an aperture that is open to a front side of the block that is oriented to be on the same side as the front side of the channel box;

wherein the toe plate has a threshold edge, a toe plate flange, and a tongue extending backwardly on the opposite side of the toe plate flange from the threshold edge, and wherein the tongue is sized to slidably fit into the aperture in the front side of the block, whereby the toe plate may be removably mounted in the block and adjacent the front side of the channel box.

2. A mullion receptacle assembly as described in claim 1, wherein the side edge flanges of the channel box include fastener apertures therethrough.

3. A mullion receptacle assembly as described in claim 1, wherein the toe plate front edge flange is beveled.

4. A mullion receptacle assembly as described in claim 1, wherein the tongue and the block have lock holes respectively therein that are adapted to be aligned when the tongue is mounted in the block, and the aligned holes are adapted to allow a locking bar to pass slidably into the holes.

5. A mullion receptacle assembly as described in claim 1, wherein the substantially rectangular shape is sized to fit within the inside diameter of a hollow mullion that may be mounted thereon.

6. A mullion receptacle assembly as described in claim 1, wherein the block is substantially square in shape.

7. In combination, a threshold and a mullion receptacle assembly adapted for use in a threshold, the combination comprising:

a threshold having a length and a width, and further having a rectangular cutout therein that is open to one side of the threshold, the threshold cutout adapted to and sized to receive a mullion receptacle assembly therein; and the mullion receptacle assembly comprising a channel box, a block, and a toe plate;

wherein the channel box has a rectangular base connected at the bottom of a pair of sidewalls on opposite sides of the base, and raised side edge flanges attached to the top of each sidewall with the base, sidewalls and flanges forming a rectangular channel and defining a channel width between the sidewalls, and wherein the channel box has a front side that is open to the base;

wherein the block is generally rectangular in shape and is sized to fit inside the channel box and is further adapted to be attached to the base of the channel box, wherein the block has a block width that is less than the channel width and further wherein the block is attached to the base in generally the middle of the base so that slots are formed on either side of the block between the block and the channel box sidewalls, and further wherein the block is hollow and has an aperture that is open to a front side of the block that is oriented to be on the same side as the front side of the channel box;

wherein the toe plate has a threshold edge, a toe plate flange, and a tongue extending backwardly on the opposite side of the toe plate flange from the threshold edge, and wherein the tongue is sized to slidably fit into the aperture in the front side of the block, whereby the toe plate may be removably mounted in the block and adjacent the front side of the channel box.

8. A combination of a threshold and mullion receptacle assembly as described in claim 7, wherein the threshold has an inside edge and an outside edge along the length of the threshold on opposite sides thereof, and the inside and outside edges of the threshold are beveled, and wherein the toe plate front edge flange is beveled to a similar angle and shape.

9. A combination of a threshold and mullion receptacle assembly as described in claim 7, wherein the side edge flanges of the channel box include fastener apertures therethrough.

10. A combination of a threshold and mullion receptacle assembly as described in claim 7, wherein the tongue and the block have lock holes respectively therein that are adapted to be aligned when the tongue is mounted in the block, and the aligned holes are adapted to allow a locking bar to pass slidably through the holes.

* * * * *